US005782266A

United States Patent [19]

Domke

[11] Patent Number: 5,782,266

[45] Date of Patent: Jul. 21, 1998

[54] PRESSURE RELIEF VALVE FOR A PACKAGING CONTAINER

[75] Inventor: Klaus Domke, Ditzingen, Germany

[73] Assignee: Robert Bosch GmbH, Stuttgart, Germany

[21] Appl. No.: 669,373

[22] Filed: Sep. 6, 1996

[30] Foreign Application Priority Data

Nov. 5, 1994 [DE] Germany ..... 44 39 591.4

[51] Int. Cl.[6] ..... F16K 37/00; B65D 33/01

[52] U.S. Cl. ..... 137/551; 383/103

[58] Field of Search ..... 137/551, 534; 383/103

[56] References Cited

U.S. PATENT DOCUMENTS

| | | | |
|---|---|---|---|
| 2,927,722 | 3/1960 | Metzger | 383/103 X |
| 2,946,502 | 7/1960 | Metzger | 383/103 X |
| 3,949,934 | 4/1976 | Goglio | 383/103 |
| 4,134,535 | 1/1979 | Barthels et al. | 383/103 X |
| 4,653,661 | 3/1987 | Buchner et al. | 383/103 X |
| 5,263,777 | 11/1993 | Domke | 383/103 |
| 5,354,133 | 10/1994 | Rapparini | 383/103 |

*Primary Examiner*—John Rivell

*Attorney, Agent, or Firm*—Edwin E. Greigg; Ronald E. Greigg

[57] ABSTRACT

A pressure relief valve for a packaging container has a flexible valve member that is fastened with parallel edge zones thereby covering a hole in the package wall. In order to protect the packaging container equipped with the pressure relief valve against theft, an alarm triggering device is integrated into the pressure relief valve. The alarm triggering device has the shape of a strip that is glued to the valve membrane on one of its fastening edge zones.

10 Claims, 2 Drawing Sheets

PRESSURE RELIEF VALVE FOR A PACKAGING CONTAINER

BACKGROUND OF THE INVENTION

The invention is based on a pressure relief valve for a packaging container in order to prevent an excessive pressure from building up in coffee packages due to the carbon dioxide generation of the packaged coffee and to prevent atmospheric oxygen from getting inside the package, a pressure relief valve, which is known for example from EP-A-00 23 703, is attached to the wall of the packaging container via a through opening. This pressure relief valve has a flexible valve membrane that is glued so that two parallel edge zones are directly or indirectly connected to the package wall, leaving a central channel free. In addition, the pressure relief valve has spacer strips glued to the valve membrane over the adhesion zones, which strips prevent the pressure of a package resting against it from impairing the function of the free central zone of the valve membrane which can be lifted. In the case of expensive products, it is known that these are secured against theft in self-service stores. To that end, the packages have labels that are for example adhesive, in which an alarm triggering device is disposed in the form of a signal strip. If a sticker of this kind is not de-activated at the cash register, the signal device triggers an alarm device at the exit.

The object of the invention is to take coffee packages that are equipped with a pressure relief valve and equip them with an anti-theft protection that is simple to affix. The attainment of this object is achieved by means of the measures set forth hereinafter.

ADVANTAGES OF THE INVENTION

The pressure relief valve according to the invention, which is mass produced, can be easily equipped with a known alarm triggering device. As a result, it is possible to attach the alarm triggering device to the packaging along with the pressure relief valve, without requiring an additional work cycle to do the attachment. Furthermore, this produces the advantage that the alarm device is attached to the package in an inconspicuous manner.

Advantageous improvements and updates of the pressure relief valve disclosed are possible by means of the measures taken herein. In the case of a pressure relief valve with spacer strips, it is particularly advantageous to dispose the strip-shaped alarm triggering device in contact with a spacer strip.

BRIEF DESCRIPTION OF THE DRAWINGS

In FIGS. 2 to 4, the heights are shown enlarged in relation to the lengths.

DESCRIPTION OF THE EXEMPLARY EMBODIMENTS

Figure 1:
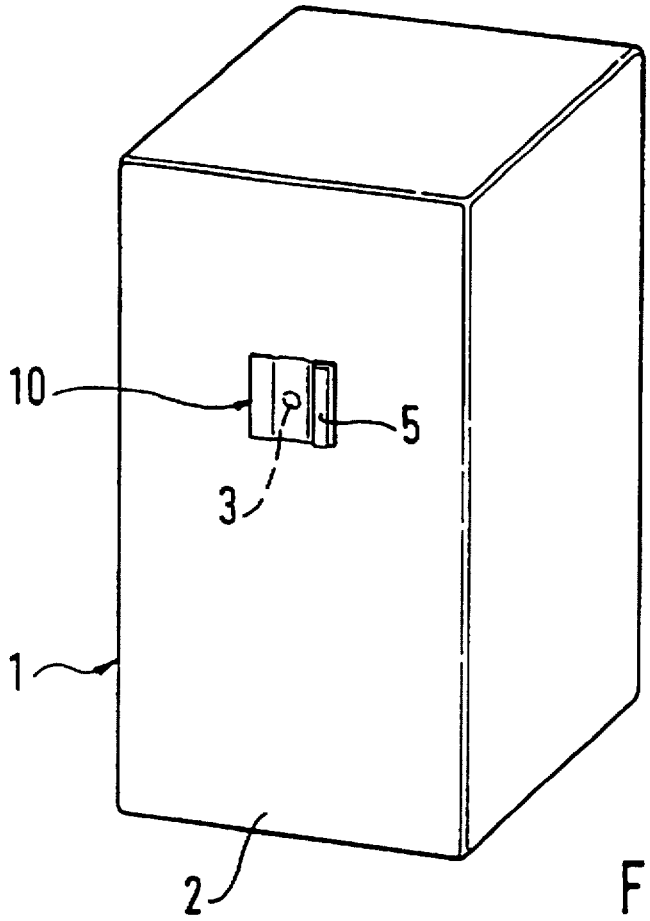
FIG. 1 shows a simplified diagram view of a bag with a pressure relief valve.
Figure 2:
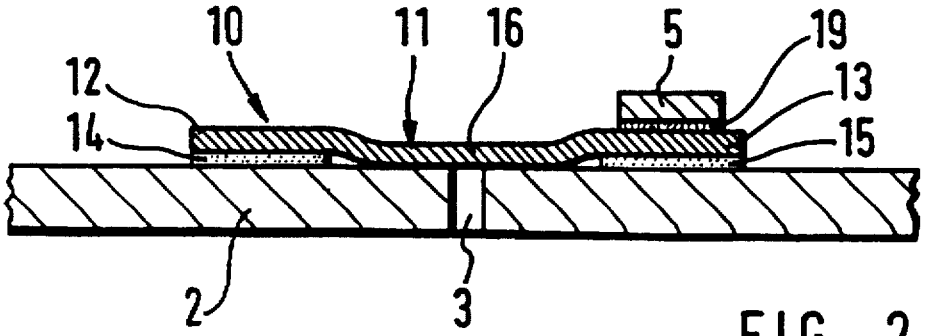
FIG. 2 shows a cross section of a first exemplary embodiment of a pressure relief valve.

On a side wall of a packaging container 1 tightly packed with coffee for example, a pressure relief valve 10 is attached to cover a through opening 3 in the wall 2 of the packaging container 1. In the exemplary embodiment according to FIG. 1, the pressure relief valve 10 has a valve membrane 11 in the shape of a small plate that is fastened to the outside of the wall 2 by means of two strip-shaped adhesive layers 14, 15, preferably of a contact cement, on two parallel edge zones 12, 13 of the valve membrane 11, covering the through opening 3 in the center. In the event that an excess pressure builds up in the packaging container 1, the central, free zone 16 is lifted up from the wall 2 so that gas can escape outward from the inside of the packaging container 1 by means of the channel formed between the central zone 16 and the region of the wall 2 covered by it.

An alarm triggering device 5 is connected to the valve membrane 11 on one of its edge zones 12 or 13 that are glued to the wall 2. The alarm triggering device 5 has the shape of a thin, small plate or a strip that adheres to the membrane 11 by means of an adhesive layer 19. In the vicinity of a scanning device, the alarm triggering device 5 triggers an alarm if it is not de-activated beforehand. The alarm device 5 attached to the pressure relief valve 10 consequently serves as an anti-theft protection.

Figure 3:
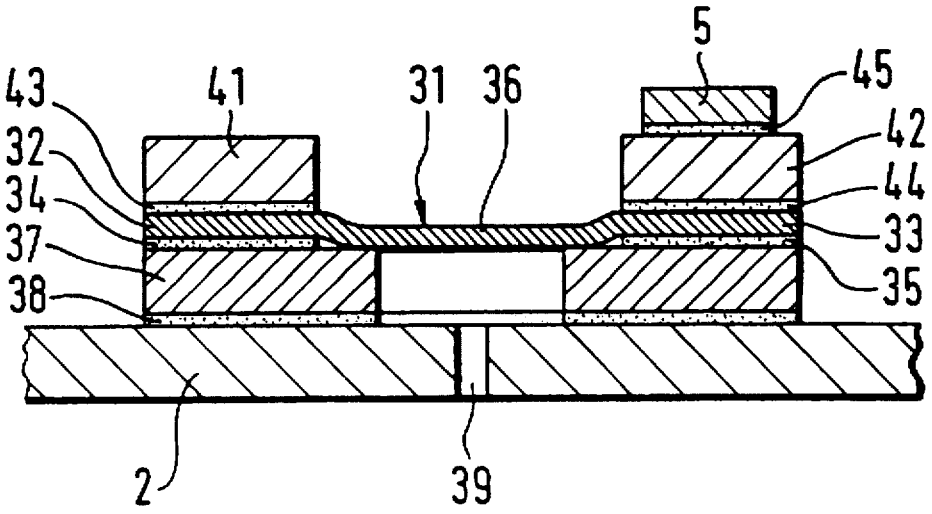
FIG. 3 shows a cross section of a second exemplary embodiment of a pressure relief valve with spacer strips.
Figure 4:
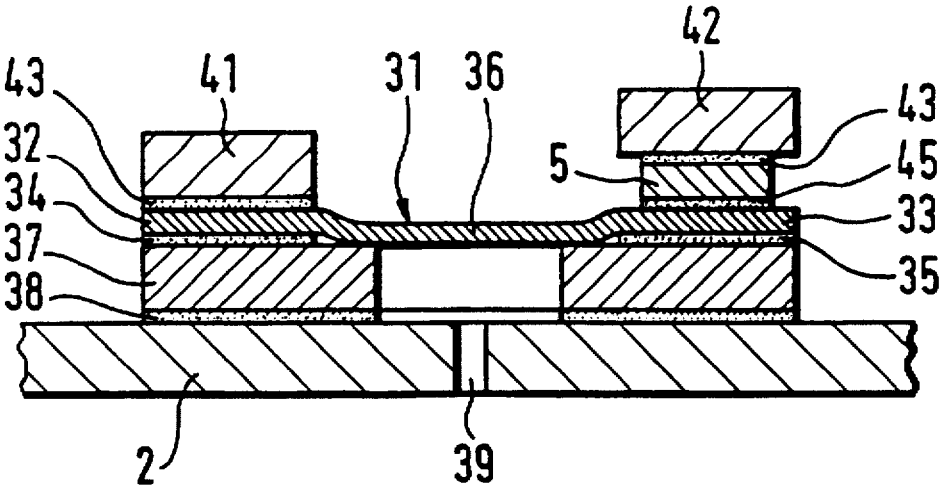
FIG. 4 shows a cross section of a third exemplary embodiment with spacer strips.

In the exemplary embodiments according to FIGS. 3 and 4, the valve membrane 31 of the pressure relief valve 10 is not fastened directly to the wall 2 of the packaging container 1, but is attached with its edge zones 32, 33 by means of adhesive layers 34, 35 to an annular, rigid base plate 37, which in turn is fastened to the package wall 2 by means of an adhesive layer 38. The rigid base plate is provided with a hole which is covered by the valve membrane 31. The central, adhesive-free zone 36 of the valve membrane 31 rests freely against the base plate 37 in a sealing manner and covers the hole in the rigid base plate. In the event that pressure is generated on the inside of the packaging container 1, the pressure acts by means of the through opening 39 and the hole in the base plate 38, and lifts the central zone 36 of the valve membrane 31 up from the base plate, forming a channel. In order to guarantee the function of the valve membrane 31, even in the event that packages rest against one another, two spacer strips 41, 42 are disposed coinciding with the fastening edge zones 32, 33 of the valve membrane 31.

In the exemplary embodiment according to FIG. 3, both spacer strips 41, 42 are fastened directly to the valve membrane 31 by means of adhesive layers 43, 44. The alarm triggering device 5 is glued to one of the spacer strips 42 by means of an adhesive layer 45. In contrast, in the exemplary embodiment according to FIG. 4, the alarm triggering device 5 is embedded between a spacer strip 41 or 42 and the valve membrane 31.

The alarm triggering device 5 is designed to be an electronic chip and preferably has the shape of a thin strip so that in the manufacture of valves 10 it can be continuously incorporated into the valves 10 by gluing and stamping plastic strips in a continuous process.

In summary, it is noted that the strip-shaped alarm triggering device 5 can also be integrated into other valve shapes that deviate from the exemplary embodiments, but are designed to be constructed of foil strips.

In addition, it is noted that to seal the valves 10, a fluid sealing medium, for example silicone oil, can be disposed in their valve channel, which covers the free, central zone 16, 36 of the valve membrane 11, 31 and the opposite contact face of the package wall 2 or the base plate 37 as well as the edges of the fastening edge zones 12, 13; 32, 33.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A pressure relief valve (10) for a packaging container (1) with a valve membrane (11; 31) that is attached to a wall (2) of the packaging container (1), the valve membrane covers a hole (3) in the wall (2) of the packaging container (1), a thin alarm triggering device (5) in the shape of a strip or a small plate is connected to an outer surface of the pressure relief valve (10).

2. A pressure relief valve according to claim 1, in which the alarm triggering device (5) is connected to an outer surface of the valve membrane (11; 31) that coincides with a fastening region (12, 13; 32, 33) thereof.

3. A pressure relief valve according to claim 2, in which the triggering device (5) is disposed on a side of the valve membrane (11, 31), which is disposed opposite from the wall (2) of the packaging container (1).

4. A pressure relief valve according to claim 3, in which the alarm triggering device (5) is covered with at least one spacer strip (41, 42), which is glued to the valve membrane (11).

5. A pressure relief valve as set forth in claim 4, in which said alarm triggering device is an electronic chip.

6. A pressure relief valve as set forth in claim 4, which includes one spacer strip.

7. A pressure relief valve as set forth in claim 4, which includes two spaced spacer strips.

8. A pressure relief valve as set forth in claim 1, in which said alarm triggering device is an electronic chip.

9. A pressure relief valve (10) for a packaging container (1) in which spacer strips (41, 42) are attached to a valve membrane (31), coinciding with two parallel fastening zones (33, 34), and an alarm device (5) is attached to an inner surface of the spacer strips (41, 42).

10. A pressure relief valve as set forth in claim 9, in which said alarm triggering device is an electronic chip.

* * * * *